US012146281B2

(12) United States Patent
Yu et al.

(10) Patent No.: US 12,146,281 B2
(45) Date of Patent: Nov. 19, 2024

(54) THROWING TOUGHNESS BUFFER MESH UNIT FOR ROCKFALL PROTECTION AND DESIGN METHOD OF CRITICAL THROWING ANGLE THEREOF

(71) Applicant: Southwest Jiaotong University, Chengdu (CN)

(72) Inventors: Zhixiang Yu, Chengdu (CN); Lijun Zhang, Chengdu (CN); Liru Luo, Chengdu (CN); Yuntao Jin, Chengdu (CN); Lei Zhao, Chengdu (CN); Xin Qi, Chengdu (CN); Shichun Zhao, Chengdu (CN)

(73) Assignee: Southwest Jiaotong University, Chengdu (CN)

( * ) Notice: Subject to any disclaimer, the term of this patent is extended or adjusted under 35 U.S.C. 154(b) by 920 days.

(21) Appl. No.: 17/200,924

(22) Filed: Mar. 15, 2021

(65) Prior Publication Data

US 2022/0178093 A1 Jun. 9, 2022

(30) Foreign Application Priority Data

Dec. 9, 2020 (CN) ..... 202011427186.0

(51) Int. Cl.
*E01F 7/04* (2006.01)

(52) U.S. Cl.
CPC ..... *E01F 7/045* (2013.01)

(58) Field of Classification Search
CPC .. E01F 7/04; E01F 7/045; E02D 17/20; E02D 17/202; G06F 30/20; G06F 2111/10
USPC ..... 256/12.5
See application file for complete search history.

(56) References Cited

U.S. PATENT DOCUMENTS 1,781,458 A * 11/1930 Gore ..... B66C 1/127 403/388
3,866,367 A * 2/1975 Strizki ..... E01F 7/045 403/2
7,234,283 B2 * 6/2007 Russo ..... E01F 7/045 256/12.5

(Continued)

FOREIGN PATENT DOCUMENTS

CH 357085 A * 9/1961 ..... E01F 7/04
DE 2428074 A1 * 12/1975 ..... E01F 7/045

(Continued)

*Primary Examiner* — Josh Skroupa
(74) *Attorney, Agent, or Firm* — Bayramoglu Law Offices LLC

(57) ABSTRACT

A throwing toughness buffer mesh unit for a rockfall protection and a design method of a critical throwing angle thereof are provided. The throwing toughness buffer mesh unit includes a cable column, wherein the cable column is provided with a sliding device on a top end and connected to a foundation structure via a hinged support at a bottom; a support rope, wherein the support rope is connected to the sliding device on the cable column in a sliding way and provided with a spring buffer on an end, wherein the spring buffer is obliquely anchored to a rock mass base near a protection structure; a protection net, which is obliquely hung on the support rope via a connector. A pavement inclination angle of the protection net is adjusted to a critical throwing angle by adjusting a height difference between cable columns to control a throwing track of falling rocks.

16 Claims, 7 Drawing Sheets

(56) References Cited

U.S. PATENT DOCUMENTS

| | | | | |
|---|---|---|---|---|
| 8,857,795 | B2 * | 10/2014 | Nishita | E01F 7/045 256/12.5 |
| 11,448,280 | B2 * | 9/2022 | Ng | E01F 7/045 |
| 11,599,692 | B2 * | 3/2023 | Yu | G06F 30/20 |
| 2005/0205853 | A1 * | 9/2005 | Pan | E01F 7/045 256/12.5 |
| 2018/0291571 | A1 * | 10/2018 | Song | E01F 7/045 |

FOREIGN PATENT DOCUMENTS

| | | | | |
|---|---|---|---|---|
| DE | 102006013526 | A1 * | 8/2007 | E01F 7/04 |
| EP | 1130166 | A2 * | 9/2001 | E01F 7/045 |
| FR | 1190613 | A * | 10/1959 | E01F 7/04 |
| KR | 20050023383 | A * | 3/2005 | E01F 7/045 |
| WO | WO-2015052745 | A1 * | 4/2015 | E01F 7/04 |

* cited by examiner

THROWING TOUGHNESS BUFFER MESH UNIT FOR ROCKFALL PROTECTION AND DESIGN METHOD OF CRITICAL THROWING ANGLE THEREOF

CROSS REFERENCE TO THE RELATED APPLICATIONS

This application is based upon and claims priority to Chinese Patent Application No. 202011427186.0, filed on Dec. 9, 2020, the entire contents of which are incorporated herein by reference.

TECHNICAL FIELD

The invention relates to the field of slope protection against geological disaster, specifically relates to a throwing toughness buffer mesh unit for rockfall protection shed-tunnel and design method thereof, and applicable to the collapse and rockfall protection in the fields of transport, land and mine.

BACKGROUND

Since ancient times, rockfall, collapses, etc. geological disasters have occurred frequently due to two-thirds of mountainous land in China, which seriously threatened the safety of people's lives and properties. For mountainous roads or bridges that have certain demand for road capacity, once collapse or rockfall disaster occurs, such roads or bridges are easily blocked and difficult to pass through, thus seriously affecting the emergency rescue and traffic recovery.

For traditional flexible protection technology, the inclination angle of toughness mesh is designed by experience. Falling rocks can be intercepted, but will naturally accumulate on the toughness mesh after the toughness meshes are used for a period of time, and need to be cleaned away manually; otherwise the performance of toughness meshes will be significantly reduced. Because the toughness meshes are mainly arranged in the wild, mountainous and distant road sections, it is difficult to clean falling rocks and maintain the structure, resulting in poor recoverability of the toughness protection system.

SUMMARY

In view of the above problems, the present invention is aimed to provide a throwing toughness buffer net unit for rockfall protection, which features good buffering capacity, self-recovery performance, effective control in rockfall throwing, and convenient for installation and maintenance, and a design method of critical throwing angle thereof.

The invention adopts the following technical scheme to realize the abovementioned objectives:

A throwing toughness buffer mesh unit for rockfall protection shed-tunnel, comprising:

- A cable column, which is provided with a sliding device on the top end and connected to the foundation structure via a hinged support at the bottom;
- A support rope, which is connected to the sliding device on the cable column in a sliding way and provided with a spring buffer on the end, wherein the spring buffer is obliquely anchored to the rock mass base near the protection structure;
- A protection net, obliquely hung on the support rope via a connector;

- The pavement inclination angle of the protection net is adjusted to the critical throwing angle θ n by adjusting the height difference between the cable columns, thus to control the throwing track of falling rocks.

Further, a flexible support is set between two adjacent cable columns.

Further, the sliding device is composed of non-interfering transverse and longitudinal chutes and the support ropes are arranged in the transverse and the longitudinal chutes to form a well-shaped support structure.

Further, the cable columns are tough, structurally made of sectional telescopic piston rods, and provided with a flange on the middle section with a tough compression spring on said flange.

Further, the hinged support is capable of rotating in multiple dimensions and the direction of cable columns may be adjusted as required.

Further, the protection net is connected to the support rope via a connector.

Moreover, the present invention also protects the said throwing toughness buffer mesh unit for rockfall protection according to any of the foregoing; a plurality of toughness buffer mesh units are arranged side by side and used in combination to form a system of throwing toughness buffer mesh units.

Additionally, the present invention also protects the design method of critical throwing angle $\theta_{min}$ of said throwing toughness buffer mesh unit for rockfall protection according to any of the foregoing, including the following steps:

(1) Estimate the ultimate deformation $\Delta_{max}$ of mesh under vertical action;

(2) Calculate the height difference Δh between the ultimate deformation point and steel column;

(3) Calculate the rebound height $h_g$ when rebounding to the edge of system;

(4) Check whether the throwing conditions are met;

(5) Repeat the Steps (1) to (4) to obtain the critical throwing angle $\theta_{min}$.

Further, given that the length of mesh paved is $l_0$, and assuming that the throwing angle on surface of buffer unit is θ, the ultimate deformation $\Delta_{max}$ in the Step (1) can be calculated as follows:

$$\Delta_{max} = \sqrt{\left(\frac{l_i - w_s}{2}\right)^2 - \left(\frac{k_R - w_s}{2}\right)^2} + h_c$$

$$l_i = l_{i0} + (n_y - n_c)\left(\frac{\pi D}{2} - D\right)\varphi$$

$$n_{ydiag} = INT\left(\gamma\frac{4l_0}{\pi D}\right) + 1$$

$$n_{cdiag} = INT\left(\frac{4w_s}{\pi D}\right) + 1$$

wherein: $l_i$ is the length of meshes in non-contact zone at the maximum impact deformation; $w_s$ is the outer diameter of falling rock; $h_R$ is the residual interception height; $h_c$ is the contact height between falling rock and mesh; $l_{i0}$ is the initial interception height of mesh, taking $l_0$ in theory; $n_y$ is the line number of rings in y direction; $n_c$ is the line number of rings in contact zone; $n_{ydiag}$ is the theoretical value of line number of rings in y direction; γ is the tightness coefficient of mesh, taking 1.1~1.3 according to the experience statistics; $n_{cdia}$ is the theoretical value of line number of rings in contact zone;

D is the diameter of rings; φ is the deflection coefficient, taking 0.55~0.9 according to the experience statistics.

Further, the ultimate elongation of the mesh under different impact conditions is constant; assuming that the impact point is located at center of mesh, and taking the impact point as the origin of local coordinate system, the ellipse trajectory equation of the lowest deformation point is defined as follows according to the first definition of ellipse:

$$\frac{x^2}{\Delta_{max}^2 + \frac{l_{i0}^2}{4}} + \frac{y^2}{\Delta_{max}^2} = 1$$

The linear equation of deformation point and impact point is:

$$y = -x \cdot \tan\theta$$

According to the ellipse trajectory equation and linear equation, the ultimate deformation height h of meshes paved is:

$$h = \Delta_{max} \cdot \sqrt{1 + \frac{l_{i0}^2}{4\Delta_{max}^2 + 4\tan^2\theta + l_{i0}^2 \cdot \tan^2\theta}}$$

The elongation $\Delta l_0$ of mesh is:

$$\Delta l_0 = \sqrt{\left(h + \frac{l}{2} \cdot \tan\theta\right)^2 + \frac{l^2}{4}} + \sqrt{\left(h - \frac{l}{2} \cdot \tan\theta\right)^2 + \frac{l^2}{4}} - l_0$$

The height difference Δh between ultimate deformation point and steel column in the Step (2) is:

$$\Delta h = h - \frac{l}{2} \cdot \tan\theta$$

wherein, l is the length of steel column.

Further, the mesh deformation follows Hooke's law without considering the plastic deformation of mesh, and the mesh tension T is:

$$T = k \cdot \Delta l_0$$

wherein: k is the equivalent stiffness of mesh;

The direction angles α and β of falling rock at the instant of rebound under the tensions $T_1$ and $T_2$ of mesh, and the component forces $F_y$ and $F_z$ along Y axis and Z axis respectively can be calculated as follows:

$$\alpha = \arctan\frac{l}{2\left(h + \frac{l}{2}\tan\theta\right)}$$

$$\beta = \arctan\frac{l}{2\left(h - \frac{l}{2}\tan\theta\right)}$$

$$F_y = T_2 \cdot \sin\beta - T_1 \cdot \sin\alpha$$

$$F_z = T_1 \cdot \cos\alpha + T_2 \cdot \cos\beta - mg$$

wherein: m is the rock mass, and g is the gravity acceleration;

The velocity v of falling rock at the instant of rebound is:

$$v = \sqrt{\frac{2(1-\eta)I_d}{m}}$$

wherein: η is the energy dissipation coefficient, taking 0.65~0.8 according to mathematical statistics; and $I_d$ is the impact energy to be prevented;

The velocities $v_y$ and $v_z$ of falling rock at the instant of rebound along Y axis and Z axis respectively are:

$$v_y = v\sqrt{\frac{F_y^2}{F_y^2 + F_z^2}}$$

$$v_z = v\sqrt{\frac{F_z^2}{F_y^2 + F_z^2}}$$

The time t required for the test block rebounding to the edge of system and the height $h_g$ of falling rock for rebounding to the edge of system in the Step (3) respectively are:

$$t = \frac{l}{2v_y}$$

$$h_g = v_z t - \frac{1}{2}gt^2$$

Further, when the height $h_g$ of falling rock for rebounding to the edge of system meets the condition of:

$$h_g > \Delta h$$

the throwing conditions in the Step (4) are meet, meaning that the falling rock can be threw out of the system.

Compared with the prior art, the invention has the following beneficial effects:

The throwing toughness buffer mesh unit for rockfall protection shed-tunnel disclosed in the invention can work independently and be combined and integrated to form a buffer unit cluster; The toughness buffer unit can effectively slow down the impact force of falling rocks and improve the shape recovery of the protection unit due to taking into account both toughness and damping of the system; the falling rock can be controlled by controlling the design of critical throwing angle. Compared with the prior art, the invention has the following beneficial effects:

(1) The throwing angle of falling rock can be controlled through control the critical throwing angle and adjusting the height of cable columns.

(2) The spring buffer is used as main buffer component, making the elasticity and damping of toughness buffer unit proper, and improving the structural toughness.

(3) The toughness buffer unit is of prefabricated unit structure, it can work independently and be used in combination with different types of she-tunnel in the form of buffer unit cluster.

Generally, the present invention is ingenious in conception, convenient in construction and installation, substantial in characteristics and progress, wide in market application prospect, and very suitable for popularization and application.

BRIEF DESCRIPTION OF THE DRAWINGS

To clearly explain the embodiments of the present invention or the technical scheme in the prior art, the drawings used in the embodiments or the description of the prior art will be briefly introduced below. Obviously, the drawings below are some embodiments of the present invention, and other drawings based on the drawings below can be obtained by ordinary technicians in this field without paying creative labor.

In the above drawings, the same reference numerals are used to indicate the same structures or components, as follows.

Figure 1:
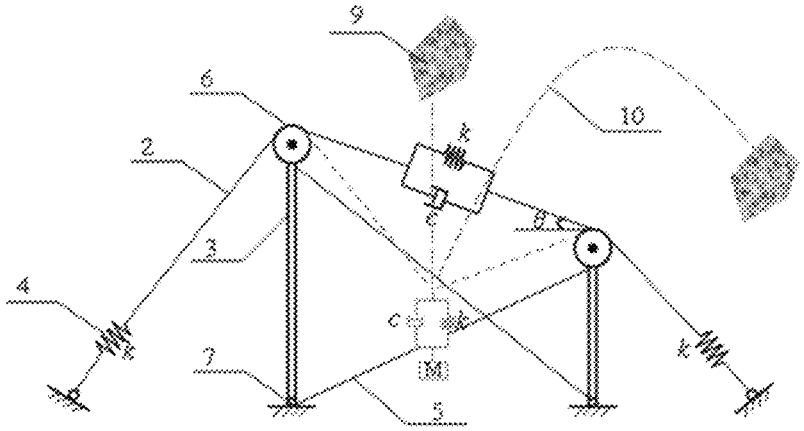
FIG. 1 is the conceptual diagram of the main structure and the schematic diagram of the subsidiary structure of the throwing toughness buffer mesh unit for rockfall protection disclosed in present invention.
Figure 2:
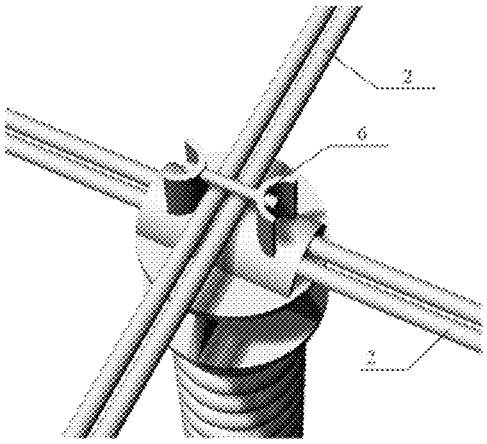
FIG. 2 is the structure diagram of sliding device of the throwing toughness buffer mesh unit for rockfall protection disclosed in present invention.
Figure 3:
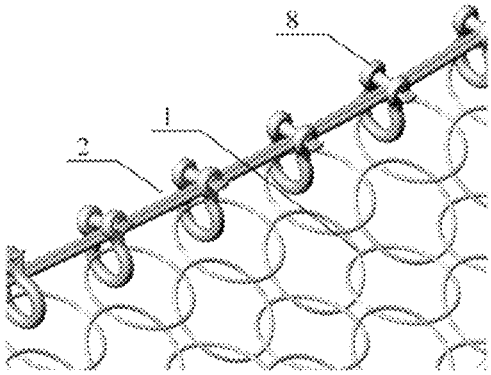
FIG. 3 is the mesh connection diagram of the throwing toughness buffer mesh unit for rockfall protection disclosed in present invention.

1—protection net, 2—support rope, 3—toughness cable column, 3'—rigid cable column, 4—spring buffer, 5—flexible support, 6—sliding device, 7—hinged support, 8—connector, 9—falling rock, 10—rockfall trajectory.

DETAILED DESCRIPTION OF THE EMBODIMENTS

To clarify the purpose, technical scheme and advantages of embodiments of the present invention, the technical scheme in embodiments of the present invention will be described clearly and completely with reference to the drawings herein. Obviously, the described embodiments are part of embodiments of the present invention, but not all of them. Based on the embodiments of the present invention, all other embodiments obtained by ordinary technicians in the field without creative labor are within the scope of protection of the present invention.

A throwing toughness buffer mesh unit for rockfall protection of the present invention is shown in FIGS. 1-6, comprising a protection net 1, a support rope 2, a cable column 3, a spring buffer 4, and a flexible support 5. Said cable column 3 is connected to the foundation structure via a hinged support 7. Preferably, the throwing toughness buffer mesh unit for rockfall protection of the present invention can be used for protection of cantilever shed-tunnel; the cantilever shed-tunnel is hung over the rock mass, and the cantilever steel column is provided with the throwing toughness buffer mesh unit and connected to the cable column 3 via a hinged support 7 at the bottom.

Said cable column 3 is provided with a sliding device 6 on the top end; said support rope 2 is connected to the sliding device 6 on the cable column 3 in a sliding way, tightened on the mountain near the protection structure at one end, and provided with a spring buffer 4 on the end near the mountain. Said protection net 1 is tightened on the support rope 2 via a connector 8. The pavement inclination angle of protection net 1 is adjusted through adjusting the height of said cable column 3. A flexible support 5 is arranged between two adjacent cable columns 3.

Figure 4:
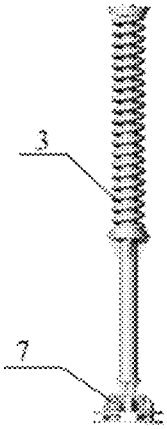
FIG. 4 is the structure diagram of toughness cable column of the throwing toughness buffer mesh unit for rockfall protection disclosed in present invention.
Figure 5:
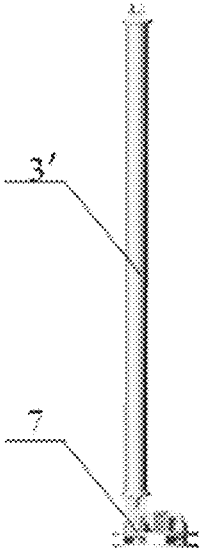
FIG. 5 is the structure diagram of rigid cable column of the throwing toughness buffer mesh unit for rockfall protection disclosed in present invention.
Figure 6:
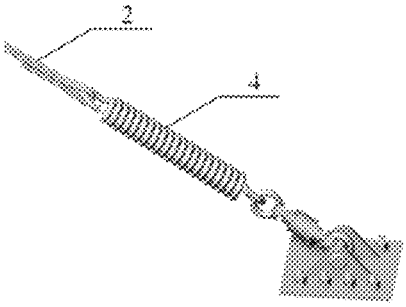
FIG. 6 is the diagram for connection between support rope and spring of the throwing toughness buffer mesh unit for rockfall protection disclosed in present invention.
Figure 7:
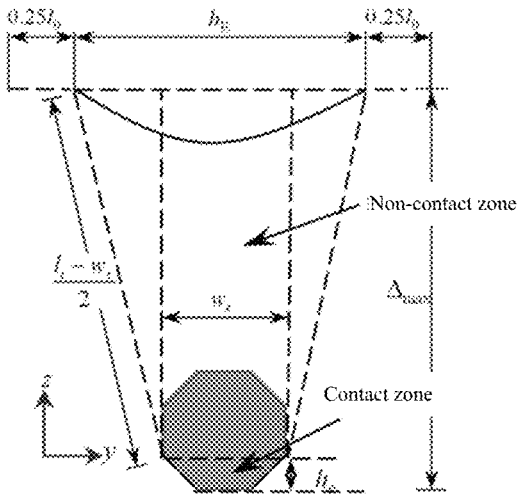
FIG. 7 is the diagram for ultimate deformation calculation of the throwing toughness buffer mesh unit for rockfall protection disclosed in present invention.
Figure 8:
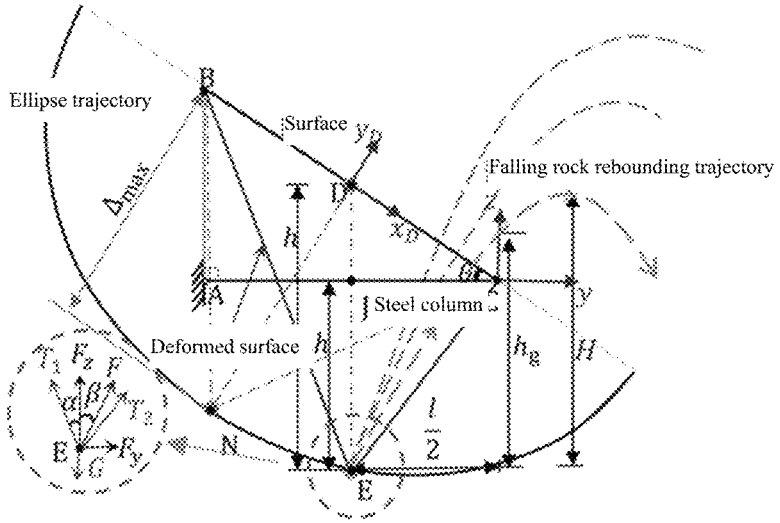
FIG. 8 is the diagram for critical throwing angle calculation of the throwing toughness buffer mesh unit for rockfall protection disclosed in present invention.
Figure 9:
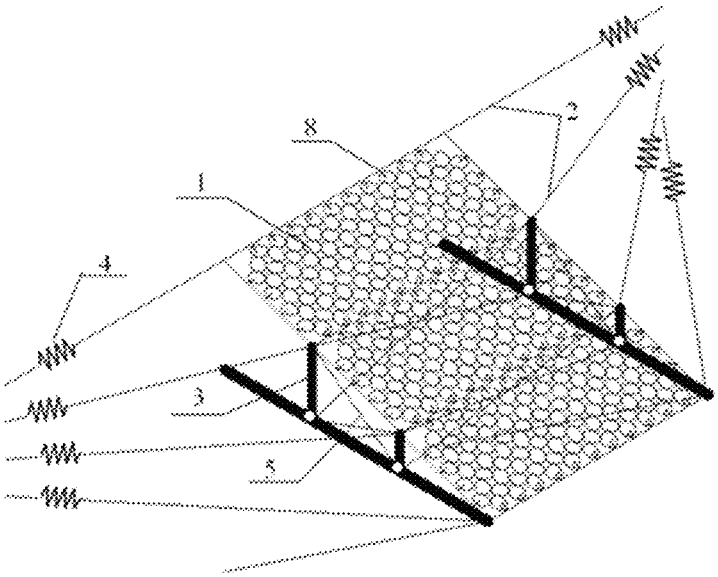
FIG. 9 is the axonometric drawing of main structure when the throwing toughness buffer mesh unit for rockfall protection disclosed in present invention is used in combination with the cantilever shed-tunnel.
Figure 10:
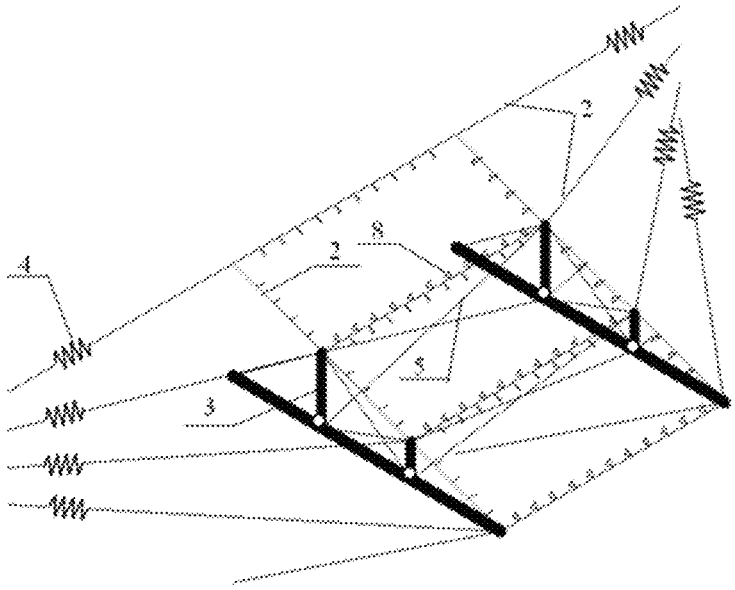
FIG. 10 is the axonometric drawing of main structure without protection net when the throwing toughness buffer mesh unit for rockfall protection disclosed in present invention is used in combination with the cantilever shed-tunnel.
Figure 11:
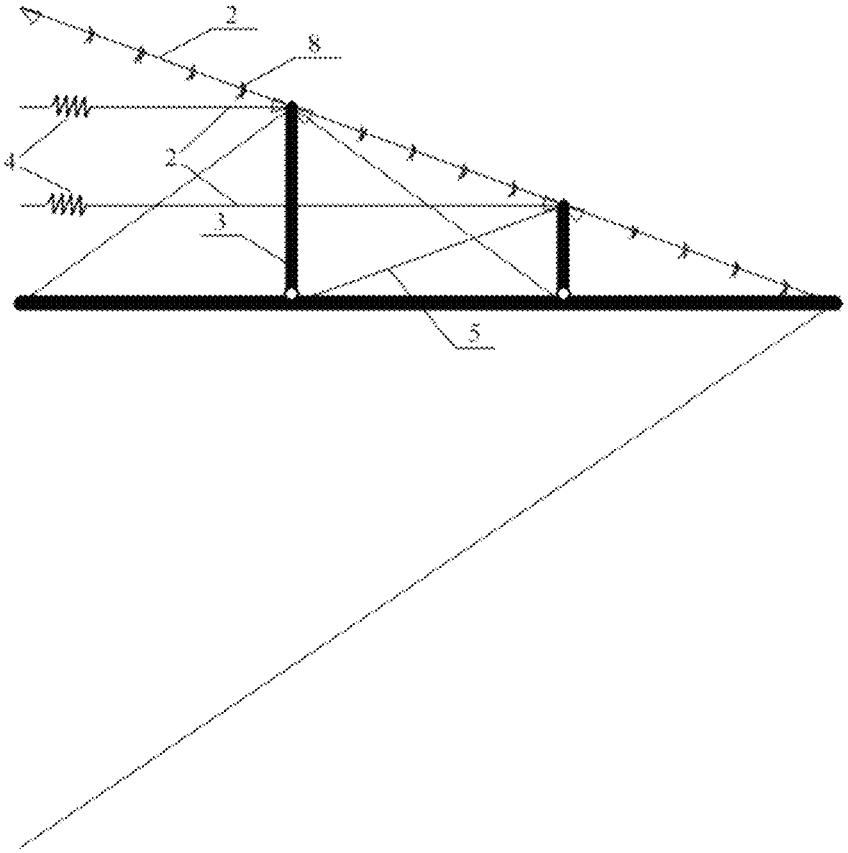
FIG. 11 is the left view of main structure without protection net when the throwing toughness buffer mesh unit for rockfall protection disclosed in present invention is used in combination with the cantilever shed-tunnel.
Figure 12:
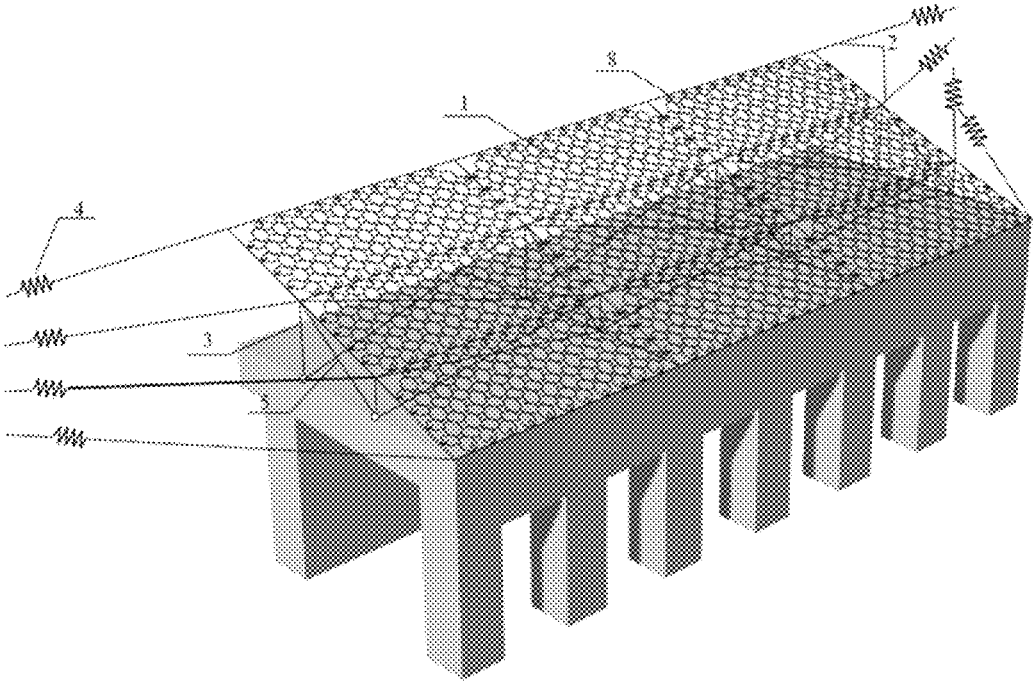
FIG. 12 is the axonometric drawing of main structure when the throwing toughness buffer mesh unit for rockfall protection disclosed in present invention is used in combination with the reinforced concrete shed-tunnel.

Said sliding device 6 is provided with non-interfering transverse and longitudinal chutes, and the transverse and the longitudinal support ropes 2 are arranged in the transverse and the longitudinal chutes respectively to form a well-shaped support structure. Preferably, the transverse or longitudinal chutes are covered with semicircular support cover to separate the transverse and the longitudinal chutes. Said protection net 1 can be connected to the support rope via a connector 8. A plurality of toughness buffer mesh units are arranged side by side and used in combination to form a system of throwing toughness buffer mesh units As shown in FIG. 4, the cable columns (3) are tough, structurally made of sectional telescopic piston rods, and provided with a flange on the middle section with a tough compression spring on said flange. As shown in FIG. 5, the cable columns (3) can be rigid cable column 3' made of steel columns.

In the present application, the throwing trajectory 10 of falling rock 9 is controlled by adjusting the height difference between cable columns 3 and the pavement inclination angle of protection net 1. Particularly, when the pavement inclination angle is set to be greater than or equal to the critical throwing angle $\theta_{min}$ of mesh, the falling rock can be threw out of the toughness buffer unit as designed.

The design method of a throwing toughness buffer mesh unit for rockfall protection will be specified in combination with some collapse and rockfall point. The steps are as follows:

See FIGS. 7-12, the target of rockfall protection at this point is determined according to the hydrogeological survey, i.e. to intercept the falling rock with a mass of 1.5 t and a diameter of 0.96 m. The impact energy to be prevented $I_d$ is 500 kJ; the protection area is 45 $m^2$; cantilever length is 4.5 m; the preset throwing angle is θ, wherein $\theta \in (0,90)$. Assuming that 0 takes 30°, then the length of mesh to be paved is $l_0 = l/\cos\theta = 5.196$ m.

Given that the diameters of falling rock and ring are 0.96 m and 0.3 m respectively; under the maximum impact deformation condition, the contact height between falling rock and mesh is 0.23 m; the deflection coefficient φ takes 0.9; and γ takes 1.2; then the theoretical values $n_{ydiag}$ and $n_{cdiag}$ of line number of rings in Y direction of buffer unit and contact zone respectively are:

$$n_{ydiag} = INT\left(\gamma\frac{4l_0}{\pi D}\right) + 1 = INT\left(1.2\times\frac{4\times 5.196}{\pi\times 0.3}\right) + 1 = 26 + 1 = 27$$

$$n_{cdiag} = INT\left(\frac{4w_s}{\pi D}\right) + 1 = INT\left(\frac{4\times 0.96}{\pi\times 0.3}\right) + 1 = 4 + 1 = 5$$

At the ultimate impact deformation, the length $l_i$ of meshes in non-contact zone is:

$$l_i = l_{i0} + (n_{ydiag} - n_{cdiag})\left(\frac{\pi D}{2} - D\right)\varphi$$
$$= 5.196 + (27 - 5)\times\left(\frac{\pi\times 0.3}{2} - 0.3\right)\times 0.9 = 8.587\ (\text{m})$$

The ultimate impact deformation $\Delta_{max}$ is:

$$\Delta_{max} = \sqrt{\left(\frac{l_i - w_s}{2}\right)^2 - \left(\frac{h_R - w_s}{2}\right)^2} + h_c$$
$$= \sqrt{\left(\frac{8.587 - 0.96}{2}\right)^2 - \left(\frac{2.598 - 0.96}{2}\right)^2} + 0.23 = 3.955\ (\text{m})$$

Assuming that the impact point is located at center of mesh, and taking the impact point as the origin of local coordinate system, the ellipse trajectory equation of the lowest deformation point is defined as follows according to the first definition of ellipse:

$$\frac{x^2}{3.955^2 + 2.598^2} + \frac{y^2}{3.955^2} = 1$$

The linear equation of deformation point and impact point is:

$$y = -x\cdot\tan 30^\circ$$

According to the ellipse trajectory equation and linear equation, the ultimate deformation height h of meshes paved is:

$$h = \Delta_{max}\cdot\sqrt{1 + \frac{l_{i0}^2}{4\Delta_{max}^2 + 4\tan^2\theta + l_{i0}^2\cdot\tan^2\theta}}$$
$$= 3.955\times\sqrt{1 + \frac{5.196^2}{4\times 3.955^2 + 4\tan^2(30^\circ) + 5.196^2\cdot\tan^2(30^\circ)}}$$
$$= 4.630\ (\text{m})$$

The elongation $\Delta l_0$ of mesh is:

$$\Delta l_0 = \sqrt{\left(h + \frac{l}{2}\cdot\tan\theta\right)^2 + \frac{l^2}{4}} + \sqrt{\left(h - \frac{l}{2}\cdot\tan\theta\right)^2 + \frac{l^2}{4}} - l_0$$
$$= \sqrt{\left(4.630 + \frac{4.5}{2}\times\tan(30^\circ)\right)^2 + \frac{4.5^2}{4}} +$$
$$\sqrt{\left(4.630 - \frac{4.5}{2}\times\tan(30^\circ)\right)^2 + \frac{4.5^2}{4}} - 5.196\ (\text{m})$$
$$= 5.165\ (\text{m})$$

The height difference $\Delta h$ between ultimate deformation point and steel column is:

$$\Delta h = h - \frac{l}{2}\cdot\tan\theta = 4.630 - \frac{4.5}{2}\times\tan 30^\circ = 3.331\ (\text{m})$$

Due to pulley effect, assuming that $T_1$ and $T_2$ are equal and equivalent to mesh tension T, and taking equivalent stiffness k of the mesh as $6.04\times 10^4$ N/m under the impact energy of 500 kJ, then according to Hooke's law, the mesh tension T is:

$$T = k\cdot\Delta l_0 = 6.04\times 10^4\times 5.165 = 311.966\ (\text{kN})$$

The direction angles α and β of falling rock at the instant of rebounding under the mesh tension $T_1$ and $T_2$ can be respectively obtained according to the geometrical relationship:

$$\alpha = \arctan\frac{l}{2\left(h + \frac{l}{2}\tan\theta\right)} = \arctan\frac{4.5}{2\times\left(4.630 + \frac{4.5}{2}\times\tan(30^\circ)\right)} = 20.781^\circ$$

$$\beta = \arctan\frac{l}{2\left(h - \frac{l}{2}\tan\theta\right)} = \arctan\frac{4.5}{2\times\left(4.630 - \frac{4.5}{2}\times\tan(30^\circ)\right)} = 34.038^\circ$$

The component forces $F_y$ and $F_z$ along Y axis and Z axis respectively can be calculated as follows:

$$F_y = T_2\cdot\sin\beta - T_1\cdot\sin\alpha$$
$$= 311.966\times\sin(34.038^\circ) - 311.966\times\sin(20.781^\circ)$$
$$= 63.936\ (\text{kN})$$
$$F_z = T_1\cdot\cos\alpha + T_2\cdot\cos\beta - mg$$
$$= 311.966\times\cos(34.038^\circ) + 311.966\times\cos(20.781^\circ) - 1.5\times 9.8$$
$$= 535.486\ (\text{kN})$$

Assuming that the energy dissipation coefficient η is 0.8, velocity v of falling rock at the instant of rebound can be calculated according to the law of energy conservation:

$$v = \sqrt{\frac{2(1-\eta)I_d}{m}} = \sqrt{\frac{2\times(1 - 0.8)\times 500000}{1500}} = 11.547\ (\text{m/s})$$

The velocity components $v_y$ and $v_z$ of falling rock at the instant of rebound along Y axis and Z axis respectively are:

$$v_y = v\sqrt{\frac{F_y^2}{F_y^2 + F_z^2}} = 11.547\times\sqrt{\frac{63.936^2}{63.936^2 + 535.486^2}} = 1.369\ (\text{m/s})$$

$$v_z = v\sqrt{\frac{F_z^2}{F_y^2 + F_z^2}} = 11.547\times\sqrt{\frac{535.486^2}{63.936^2 + 535.486^2}} = 11.466\ (\text{m/s})$$

The time t required for the test block rebounding to the edge of system is:

$$t = \frac{l}{2v_y} = \frac{4.5}{2 \times 1.369} = 1.644 \text{ (s)}$$

The height $h_g$ of falling rock for rebounding to the edge of system is:

$$h_g = v_z t - \tfrac{1}{2} = 11.466 \times 1.644 - \tfrac{1}{2} \times 9.8 \times 1.644^2 = 5.607 \text{ (m)}$$

If $h_g > \Delta h$, the throwing conditions are met.

Through cycling the above steps, it is found that the critical throwing angle meeting the throwing conditions is: $\theta_{min} = 24.3°$.

Finally, whether it meets the functional requirements can be verified by experimental research or numerical simulation.

Lastly, it should be noted that the above embodiments are for illustrating the technical scheme of present invention only, but not to limit it. Although the present invention has been described in detail with reference to the foregoing embodiments, ordinary technicians in this field should understand that the technical solutions described in foregoing embodiments can still be modified, or some of technical features can be equivalently replaced; however, these modifications or substitutions do not make the essence of corresponding technical solutions deviated from the spirit and scope of the technical solutions of each embodiment of the present invention.

What is claimed is:

1. A throwing toughness buffer mesh unit for a rockfall protection shed-tunnel, comprising:

cable columns, wherein each cable column of the cable columns is provided with a sliding device on a top end and connected to a foundation structure via a hinged support at a bottom;

support ropes, wherein each of the support ropes is connected to the sliding device on the each cable column in a sliding way and provided with a spring buffer on an end, wherein the spring buffer is obliquely anchored to a rock mass base near a protection structure;

a protection net, wherein the protection net is obliquely hung on the support ropes via a connector; and a pavement inclination angle of the protection net is adjusted to a critical throwing angle $\theta_{min}$ by adjusting a height difference between the cable columns to control a throwing track of a falling rock;

the critical throwing angle $\theta_{min}$ is designed with following steps:

(1) estimating an ultimate deformation $\Delta_{max}$ of a mesh under a vertical action;

(2) calculating a height difference $\Delta_h$ between an ultimate deformation point and a steel column;

(3) calculating a rebound height $h_g$ when rebounding to an edge of a system;

(4) checking whether throwing conditions are met; and (5) repeating steps (1) to (4) to obtain the critical throwing angle $\theta_{min}$.

2. The throwing toughness buffer mesh unit according to claim 1, wherein a flexible support is set between two adjacent cable columns of the cable columns.

3. The throwing toughness buffer mesh unit according to claim 2, wherein the sliding device is composed of transverse chutes and longitudinal chutes, the transverse chutes and the longitudinal chutes are non-interfering, and the support ropes are arranged in the transverse chutes and the longitudinal chutes to form a well-shaped support structure.

4. The throwing toughness buffer mesh unit according to claim 2, wherein the hinged support is configured for rotating in a plurality of dimensions and a direction of the each cable column is adjusted as required.

5. The throwing toughness buffer mesh unit according to claim 2, wherein the protection net is connected to the support ropes via the connector.

6. The throwing toughness buffer mesh unit according to claim 2, wherein a plurality of throwing toughness buffer mesh units are arranged side by side and used in combination to form a system of the throwing toughness buffer mesh units.

7. The throwing toughness buffer mesh unit according to claim 1, wherein the sliding device is composed of transverse chutes and longitudinal chutes, the transverse chutes and the longitudinal chutes are non-interfering, and the support ropes are arranged in the transverse chutes and the longitudinal chutes to form a well-shaped support structure.

8. The throwing toughness buffer mesh unit according to claim 1, wherein the hinged support is configured for rotating in a plurality of dimensions and a direction of the each cable column is adjusted as required.

9. The throwing toughness buffer mesh unit according to claim 1, wherein the protection net is connected to the support ropes via the connector.

10. The throwing toughness buffer mesh unit according to claim 1, wherein a plurality of throwing toughness buffer mesh units are arranged side by side and used in combination to form a system of the throwing toughness buffer mesh units.

11. The throwing toughness buffer mesh unit according to claim 1, wherein a length of a mesh paved is $l_0$, and assuming the critical throwing angle on a surface of the throwing toughness buffer mesh unit is $\theta$, the ultimate deformation $\Delta_{max}$ in the step (1) is calculated as follows:

$$\Delta_{max} = \sqrt{\left(\frac{l_i - w_s}{2}\right)^2 - \left(\frac{h_R - w_s}{2}\right)^2} + h_c$$

$$l_i = l_{i0} + (n_y - n_c)\left(\frac{\pi D}{2} - D\right)\varphi$$

$$n_{ydiag} = INT\left(\gamma \frac{4l_0}{\pi D}\right) + 1$$

$$n_{cdiag} = INT\left(\frac{4w_s}{\pi D}\right) + 1$$

wherein $l_i$ is a length of a mesh in a non-contact zone at a maximum impact deformation;

$w_s$ is an outer diameter of the falling rock;

$h_R$ is a residual interception height;

$h_c$ is a contact height between the falling rock and the mesh;

$l_{i0}$ is an initial interception height of the mesh, taking $l_0$ in theory;

$n_y$ is a line number of rings in a y direction;

$n_c$ is a line number of the rings in a contact zone;

$n_{ydiag}$ is a theoretical value of the line number of the rings in the y direction;

$\gamma$ is a tightness coefficient of the mesh, wherein $\gamma$ is 1.1-1.3 according to an experience;

$n_{cdia}$ is a theoretical value of the line number of the rings in the contact zone;

D is a diameter of the rings;

$\varphi$ is a deflection coefficient, wherein $\varphi$ is 0.55-0.9 according to experience statistics.

12. The throwing toughness buffer mesh unit according to claim 11, wherein when the rebound height hg of the falling rock for rebounding to the edge of the system meets the condition of:

$$h_g > \Delta h$$

the throwing conditions in the step (4) are met, wherein the falling rock is thrown out of the system.

13. The throwing toughness buffer mesh unit according to claim 1, wherein an ultimate elongation of the mesh under different impact conditions is constant; assuming an impact point is located at a center of the mesh, and taking the impact point as an origin of a local coordinate system, an ellipse trajectory equation of a lowest deformation point is defined as follows according to a first definition of an ellipse:

$$\frac{x^2}{\Delta_{max}^2 + \frac{l_{i0}^2}{4}} + \frac{y^2}{\Delta_{max}^2} = 1$$

a linear equation of the lowest deformation point and the impact point is:

$$y = -x \cdot \tan\theta$$

according to the ellipse trajectory equation and the linear equation, an ultimate deformation height h of the mesh paved is:

$$h = \Delta_{max} \cdot \sqrt{1 + \frac{l_{i0}^2}{4\Delta_{max}^2 + 4\tan^2\theta + l_{i0}^2 \cdot \tan^2\theta}}$$

an elongation $\Delta l_0$ of the mesh is:

$$\Delta l_0 = \sqrt{\left(h + \frac{l}{2} \cdot \tan\theta\right)^2 + \frac{l^2}{4}} + \sqrt{\left(h - \frac{l}{2} \cdot \tan\theta\right)^2 + \frac{l^2}{4}} - l_0$$

the height difference $\Delta h$ between the ultimate deformation point and the steel column in the step (2) is:

$$\Delta h = h - \frac{l}{2} \cdot \tan\theta$$

wherein, l is a length of the steel column.

14. The throwing toughness buffer mesh unit according to claim 1, wherein a mesh deformation follows Hooke's law without considering a plastic deformation of the mesh, and a mesh tension Tis:

$$T = k \cdot \Delta l_0$$

wherein k is an equivalent stiffness of the mesh;

direction angles $\alpha$ and $\beta$ of the falling rock at an instant of a rebound under tensions $T_1$ and $T_2$ of the mesh, and component forces $F_y$ and $F_z$ along Y axis and Z axis respectively are calculated as follows:

$$\alpha = \arctan\frac{l}{2\left(h + \frac{l}{2}\tan\theta\right)}$$

$$\beta = \arctan\frac{l}{2\left(h - \frac{l}{2}\tan\theta\right)}$$

$$F_y = T_2 \cdot \sin\beta - T_1 \cdot \sin\alpha$$

$$F_z = T_1 \cdot \cos\alpha + T_2 \cdot \cos\beta - mg$$

wherein m is a rock mass, and g is a gravity acceleration;

a velocity v of the falling rock at the instant of the rebound is:

$$v = \sqrt{\frac{2(1-\eta)I_d}{m}}$$

wherein $\eta$ is an energy dissipation coefficient and $\eta$ is 0.65-0.8 according to mathematical statistics; and $I_d$ is an impact energy to be prevented;

velocities $v_y$ and $v_z$ of the falling rock at the instant of the rebound along the Y axis and the Z axis respectively are:

$$v_y = v\sqrt{\frac{F_y^2}{F_y^2 + F_z^2}}$$

$$v_z = v\sqrt{\frac{F_z^2}{F_y^2 + F_z^2}}$$

a time t required for a test block rebounding to the edge of the system and the rebound height hg of the falling rock for rebounding to the edge of the system in the step (3) respectively are:

$$t = \frac{l}{2v_y}$$

$$h_g = v_z t - \frac{1}{2}gt^2.$$

15. The throwing toughness buffer mesh unit according to claim 1 wherein a flexible support is set between two adjacent cable columns of the cable columns.

16. The throwing toughness buffer mesh unit according to claim 1, wherein the sliding device is composed of transverse chutes and longitudinal chutes, the transverse chutes and the longitudinal chutes are non-interfering, and the support ropes are arranged in the transverse chutes and the longitudinal chutes to form a well-shaped support structure.

* * * * *